US010935256B2

(12) United States Patent
Suarez et al.

(10) Patent No.: US 10,935,256 B2
(45) Date of Patent: Mar. 2, 2021

(54) CLIMATE CONTROL DEVICE

(71) Applicant: SUAREZ CORPORATION INDUSTRIES, North Canton, OH (US)

(72) Inventors: Benjamin D. Suarez, Canton, OH (US); Joseph L. Florence, Parkersburg, WV (US); John W. Florence, Parkersburg, WV (US); Cary L. Schmidt, Parkersburg, WV (US)

( * ) Notice: Subject to any disclaimer, the term of this patent is extended or adjusted under 35 U.S.C. 154(b) by 51 days.

(21) Appl. No.: 16/377,933

(22) Filed: Apr. 8, 2019

(65) Prior Publication Data

US 2019/0309961 A1 Oct. 10, 2019

Related U.S. Application Data

(60) Provisional application No. 62/654,726, filed on Apr. 9, 2018.

(51) Int. Cl.

| | |
|---|---|
| ***F24F 1/009*** | (2019.01) |
| ***F24F 3/14*** | (2006.01) |
| ***F24F 1/0071*** | (2019.01) |
| ***F24F 1/037*** | (2019.01) |
| ***F24F 6/00*** | (2006.01) |
| ***F24F 1/028*** | (2019.01) |

(52) U.S. Cl.

CPC ..... *F24F 1/009* (2019.02); *F24F 1/0071* (2019.02); *F24F 1/028* (2019.02); *F24F 1/037* (2019.02); *F24F 3/14* (2013.01); *F24F 6/00* (2013.01); *F24F 2006/006* (2013.01)

(58) Field of Classification Search

CPC .. F24F 1/009; F24F 3/14; F24F 1/0071; F24F 1/037; F24F 6/00; F24F 1/028; F24F 2006/006; F24F 5/0042

See application file for complete search history.

(56) References Cited

U.S. PATENT DOCUMENTS

| | | | | |
|---|---|---|---|---|
| 4,700,051 A * | 10/1987 | Goessler | ..... | H05B 3/744 219/448.11 |
| 5,592,647 A * | 1/1997 | Yamauchi | ..... | H05B 3/14 392/432 |
| 6,327,427 B1 | 12/2001 | Burkett | | |
| 6,626,835 B1 * | 9/2003 | Kraus | ..... | G01J 5/0003 374/E13.003 |

(Continued)

OTHER PUBLICATIONS

Direct-to-consumer advertisement, "New 360° Bladeless Fan cools better than a high power ceiling fan," mailed Dec. 24, 2014, Media Services, USA.

(Continued)

*Primary Examiner* — Emmanuel E Duke

(74) *Attorney, Agent, or Firm* — Pearne & Gordon LLP

(57) ABSTRACT

A heating and cooling apparatus is disclosed that combines a PTC heating element with a fan, and a combination of a cooling device aided by a thermoelectric cooling device to provide heating, passive air conditioning, and air circulation. The heating and cooling apparatus can include a condensation trap, a collection container, and an ozone generator for collecting and purifying the condensate. In addition, this apparatus provides the additional function of serving as an air purification system operating either in combination with the heating/cooling functions or as an independent air purifier.

19 Claims, 16 Drawing Sheets

(56) References Cited

U.S. PATENT DOCUMENTS

| | | | | |
|---|---|---|---|---|
| 7,046,918 | B1 | 5/2006 | Burkett et al. | |
| 2006/0177356 | A1* | 8/2006 | Miller | A61M 11/06 422/121 |
| 2009/0148141 | A1* | 6/2009 | Shapiro | F24H 3/0411 392/367 |
| 2015/0033942 | A1* | 2/2015 | Zhang | B01D 53/0407 95/1 |
| 2019/0128589 | A1* | 5/2019 | Adams | F25D 17/06 |

OTHER PUBLICATIONS

Direct-to-consumer advertisement, "Heating and Cooling Bills to Skyrocket—First ever portable climate control unit slashes your heating and cooling bills—No outdoor venting for cooling," mailed Dec. 8, 2014, Media Services, USA.

Direct-to-consumer advertisement, "Heating and Cooling Bills to Skyrocket—First ever portable climate control unit slashes your heating and cooling bills—No outdoor venting for cooling," mailed Dec. 29, 2014, Media Services, USA.

Direct-to-consumer advertisement, "Heating and Cooling Bills to Skyrocket—First ever portable climate control unit slashes your heating and cooling bills—No outdoor venting for cooling," mailed Dec. 16, 2014, Media Services, USA.

Direct-to-consumer advertisement, "New 360° Bladeless Fan cools better than a high power ceiling fan," mailed May 29, 2015, Media Services, USA.

Direct-to-consumer advertisement, "New Portable 360 Super Climater slashes your cooling and heating bills," mailed Jun. 24, 2016, Media Services, USA.

Direct-to-consumer advertisement, "New Portable 360 Super Climater slashes your cooling and heating bills," mailed Jul. 1, 2016, EdenPURE®, USA.

Direct-to-consumer advertisement, "New Portable 360 Super Climater slashes your cooling and heating bills," mailed Jul. 13, 2016, EdenPURE®, USA.

Direct-to-consumer advertisement, "New Portable 360 Super Climater slashes your cooling and heating bills," mailed Aug. 19, 2016, EdenPURE®, USA.

Direct-to-consumer advertisement, "New Portable 360 Super Climater slashes your cooling and heating bills," mailed Sep. 19, 2016, EdenPURE®, USA.

Direct-to-consumer advertisement, "New Portable 360 Super Climater slashes your cooling and heating bills," mailed Oct. 6, 2016, EdenPURE®, USA.

Direct-to-consumer advertisement, "Rebate Notification" with "New Portable 360 Super Climater slashes your cooling and heating bills," 2 pages, mailed Jan. 5, 2017, EdenPURE®, USA.

Direct-to-consumer advertisement, "Rebate Notification" with "New appliance creates a Paradise Climate in your home Slashes heating and cooling bills Has the best air purifier," 2 pages, mailed Oct. 18, 2018, EdenPURE®, USA.

"Plasma Air—PA 600 Ionized Product Submittal", 1 page, © 2018, Plasma Air International, Stamford, CT.

* cited by examiner

CLIMATE CONTROL DEVICE

RELATED APPLICATION

This application claims the benefit of U.S. Provisional application No. 62/654,726 filed on Apr. 9, 2018, which is in its entirety incorporated herein by reference.

FIELD OF THE INVENTION

The present application relates generally to a portable heating and cooling apparatus. More particularly, it relates to an apparatus that is capable of providing a localized heating or cooling effect without the need to vent the exhaust created by the heating and cooling apparatus to the exterior of a structure in which the heating and cooling apparatus is operating.

BACKGROUND OF THE INVENTION

Individual rooms of a house or other structure may be kept at different temperatures based on the occupants' preferences, needs, physical conditions, etc. In order to alter the temperature of a room users typically adjust the thermostat, which might affect multiple rooms of the house or other structure. Separate heating units (i.e., space heaters), air conditioners, or fans could be used to increase or decrease the temperature in a room or to circulate the air in the room. However, the use of separate devices can take up considerable space and create unwanted noise.

Another problem commonly associated with heating devices and portable air conditioning units is the need to vent the exhaust created by such devices to the exterior of the structure in which the device is being used. For example, without such a vent, the heat generated by a portable air conditioning unit is discharged back into the space to cool, thereby forcing the air conditioning unit to work harder to lower the temperature of the space, while at the same time continuing to discharge heat back into the space.

It is an objective of the present disclosure to alleviate or overcome one or more difficulties related to the prior art. It has been found that a portable heating and cooling apparatus that is capable of providing heat and passive air conditioning, as well as operating as a fan to circulate air within a confined space, does not require exterior venting. The apparatus provides a single-source localized zone heating or cooling solution that can be used year-round. Specifically, the heating and cooling apparatus combines a heater with an area fan, and the application of the Peltier effect to provide a year-round zone climate portable control unit. The apparatus could further include a condensation trap with an evaporation pan or other removable collection container and an ozone generator to purify the condensation water for consumption.

BRIEF SUMMARY OF THE INVENTION

In accordance with one aspect, a heating and cooling apparatus is composed of a heater and an area fan. The heating and cooling apparatus includes a case with a first air intake and an air outlet. An air chamber is disposed within the case and is in fluid communication with the first air intake and the air outlet, defining a primary air pathway. The apparatus further includes a fan configured to draw air through the air chamber and a PTC heating element within the air chamber and interposed between the first air intake and air outlet. A baffle is configured to direct air flow towards the PTC heating element.

In accordance with a second aspect, a heating and cooling apparatus includes a case with a first air intake and an air outlet. An air chamber is disposed within the case and is in fluid communication with the first air intake and air outlet, and defining a primary air pathway. The apparatus further includes a fan configured to draw air through the air chamber and a PTC heating element within the air chamber and interposed between the first air intake and air outlet. A baffle is configured to direct air flow towards the PTC heating element. The apparatus further includes an air purification system.

The heater includes a heat source (such as a positive temperature control (PTC) device, infrared bulbs and/or coils), a heat exchanger (such as a metal conductor like copper or any other suitable material that conducts heat), and a fan that blows air onto the heat exchanger. The thermoelectric cooling device utilizes the Peltier effect to create a heat flux between the junctions of two different types of material (typically metals). A Peltier cooler, heater, or thermoelectric heat pump is a solid-state active heat pump which transfers heat from one side of a device to the other, with consumption of electrical energy, depending on the direction of the current.

DETAILED DESCRIPTION OF PREFERRED EMBODIMENTS

Figure 1:
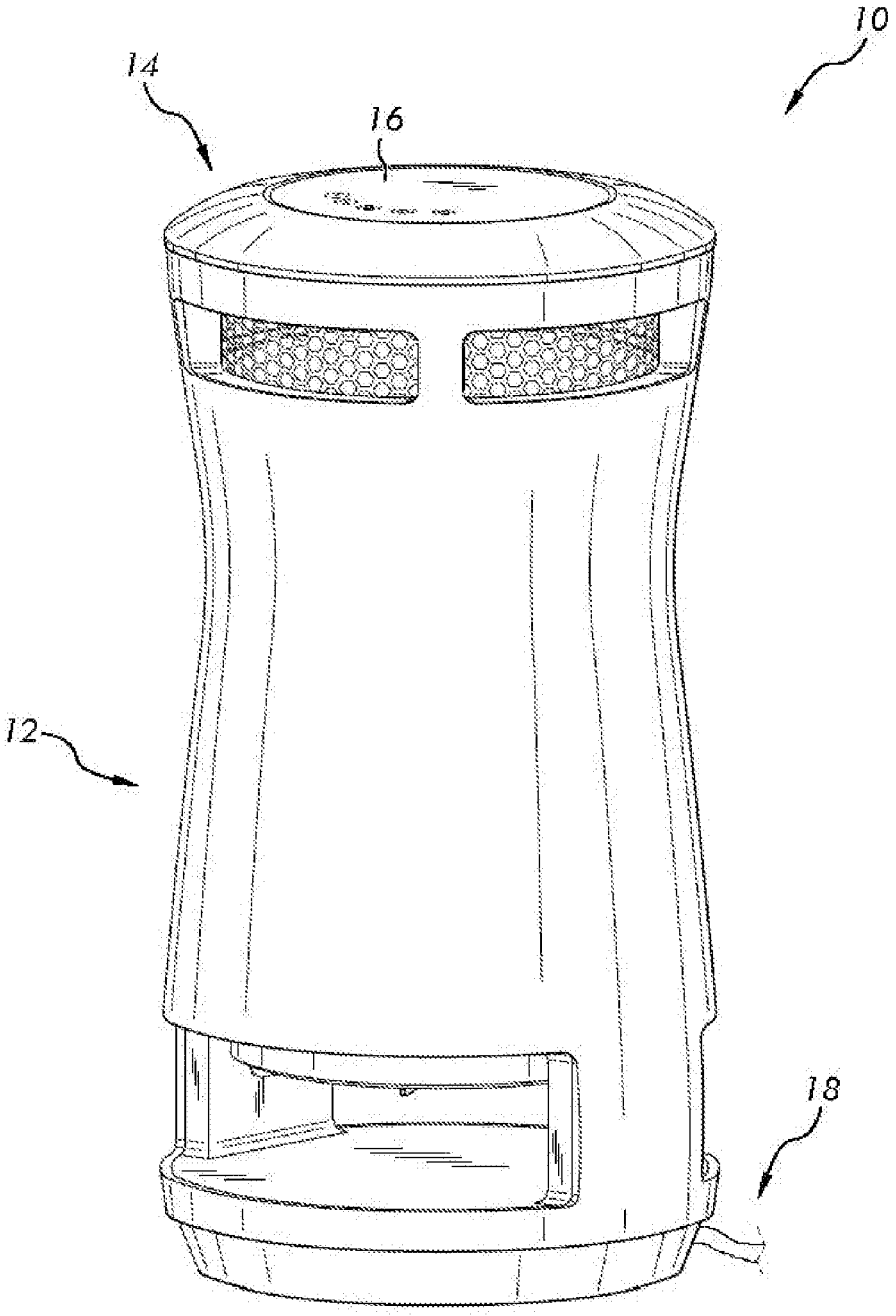
FIG. 1 is a perspective view of a heating and cooling apparatus according to a first embodiment.

Example embodiments are described and illustrated in the drawings. These illustrated examples are not intended to be limiting. For example, one or more aspects or features from each embodiment can be combined with or utilized in other embodiments.

Herein, when a range such as 5-25 (or 5 to 25) is given, this means preferably at least 5 and, separately and independently, preferably not more than 25. In an example, such a range defines independently at least 5, and separately and independently, not more than 25.

A year-round climate control heating and cooling apparatus used to provide both heating and passive air conditioning is disclosed. In one embodiment, the heating and cooling apparatus includes heating utilizing a PTC heat source aided by a fan. In another embodiment, the heating and cooling apparatus includes heating with copper heat shielding, aided by thermoelectric cooling (TEC), and thermoelectric generation (TEG). The copper shielding enables the heating and cooling apparatus to operate without reducing the humidity and oxygen in the air. Thermoelectric cooling uses the Peltier effect to create a heat flux between the junctions of two different types of materials. A Peltier cooler, heater, or thermoelectric heat pump is a solid-state active heat pump which transfers heat from one side of the device to the other, with consumption of electrical energy, depending on the direction of the current. Such an instrument is also called a Peltier device, a Peltier heat pump, a solid state refrigerator, or thermoelectric cooler. These types of devices can be used for heating, cooling, or the circulation of air in an enclosed space. The thermoelectric generator is a Peltier device that uses heat energy to generate electricity. When electric current is passed through the Peltier device, it creates a temperature difference between a Peltier first surface and a Peltier second surface. If the direction of the electric current through the Peltier device is reversed, the temperature between the Peltier first surface and Peltier second surface is reversed. Thus, in one mode of operation, the Peltier second surface becomes cooler than the Peltier first surface. In a second mode of operation, where the direction of the electric current is reversed, the Peltier first surface becomes cooler than the Peltier second surface. By attaching a radiator or other suitable device to a fan and then to a first plate which is affixed to the Peltier first surface, the Peltier first surface can be maintained at or near ambient temperature. The Peltier second surface can then be either cooled or heated with respect to the Peltier first surface, depending on the direction of current flow to the Peltier device. The TEG manages heat generated by the TEC to create electricity in order to charge a battery circuit to provide additional power to the heating and cooling apparatus. The heating and cooling apparatus is thus able to convert heat generated by the TEC into chemical energy, instead of losing thermal energy into the enclosed space. The heating and cooling apparatus may be produced in a myriad of different embodiments including, without limitation, a fan only, a heater only, a cooler only, a fan with a TEC only, a fan with a TEC and heater, or a fan with TEC, TEG, and heater functions.

Another embodiment of the heating and cooling apparatus includes a condensation trap with an evaporation pan or other removable collection container and an ozone generator to purify the condensate for consumption. This condensation collector provides access to purified and potable water via the condensation process.

In another embodiment, the heating and cooling apparatus includes 360-degree directed airflow or 120-degree directed airflow while in a fan mode, a cool mode, or a heat mode.

In another embodiment, the heating and cooling apparatus includes Bluetooth and/or Wi-Fi enabled connectivity allowing the heating and cooling apparatus to connect to various electronic devices. The heating and cooling apparatus may include USB ports, Direct Contact Charging stations, AC power plugs, and/or any other suitable charging, connecting, and/or powering methods, which could all be of various configurations, speeds, and technologies.

Embodiments of the heating and cooling apparatus provide illumination, such as color lighting, ambient lighting, visual reinforcement of the mode of operation, and/or any other suitable illumination. The heating and cooling apparatus houses the illumination component in any suitable location within the heating and cooling apparatus, including the top, bottom, base, and/or body. The illumination is provided by LED lights, fiber optics, and/or any other suitable lighting device.

In one embodiment, the heating and cooling apparatus utilizes infrared (IR) heating and a cooling device aided by a thermoelectric cooling device. IR heaters typically contain three parts that create heat: an IR heat source (e.g. IR bulb), a heat exchanger (e.g. a metal conductor like copper or any other suitable material that conducts heat), and a fan that blows air onto or across the heat exchanger. The IR heater may comprise a protective covering over the heating element and/or exchanger, which can be made from copper, iron, steel, brass, or any other suitable material known in the art. The IR heater can be made of any suitable material that conducts heat, such as ceramic. The IR heater can also utilize propane, natural gas, electricity, or any other suitable fuel source.

In the various examples described herein, the heating and cooling apparatus can include a wide variety of systems configured to condition (i.e., heat, cool, purify, etc.) air in various manners. In various non-limiting examples, as will be described herein, the heating and cooling apparatus might include any or all of a heater, cooler, filter, source of ultraviolet (UV) radiation, ion generator, various interconnecting ducting, and dampers/valves.

Where possible, the various structural elements are coupled together by a minimal number of fasteners and joints, such as by a minimal number of screws or the like, projections received in slots, or other removable or non-removable locking structure, for improved serviceability. Further, the heating and cooling apparatus can include various other elements, such as described in U.S. Pat. Nos. 6,327,427 and 7,046,918, the contents of which are incorporated herein by reference in their entirety.

Figure 2:
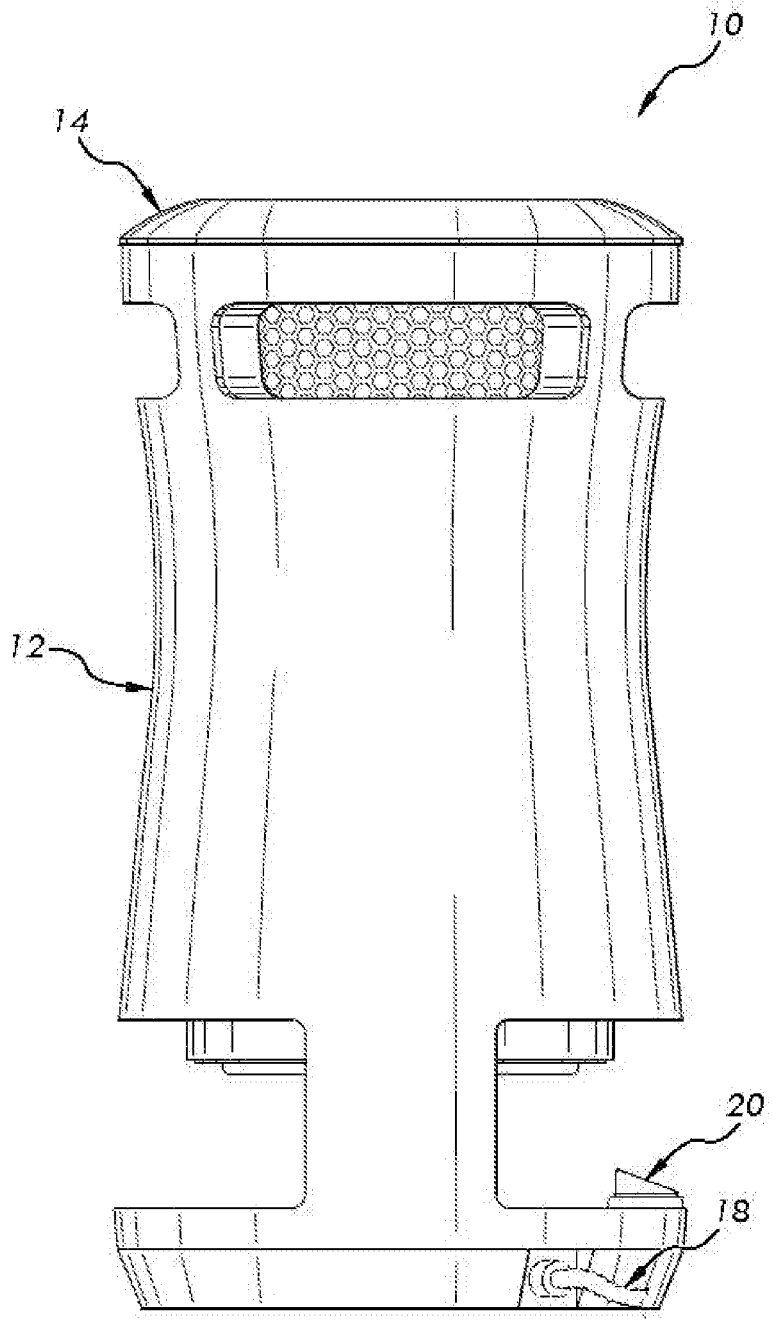
FIG. 2 is a side view of the heating and cooling apparatus of FIG. 1.

Turning to FIGS. 1 and 2, a heating and cooling apparatus 10 is illustrated. The heating and cooling apparatus 10 includes an exterior case 12, a top portion 14, a user interface 16, a power cord 18, and a power switch 20. The case 12 is generally cylindrical with a tapered upper-middle section. The case 12 includes at least one opening to provide access for the intake of air and at least one opening to provide access for the exhaust of air. In one embodiment, the case 12 is made of a metal, including steel or aluminum. The metal material can have a variety of finishes, including a polished finish. The thickness of the metal of the case 12 is between 0.010 and 0.240 inches, more preferably between 0.014 and 0.100 inches, and most preferably between 0.018 and 0.034 inches. In another embodiment, the case 12 is made of molded plastic. The outer diameter of the case 12 is preferably between 1 and 30 inches, more preferably between 4 and 25 inches, and most preferably between 7 and 20 inches. The height of the case 12 is preferably between 5 and 30 inches, more preferably between 10 and 25 inches, and most preferably between 12 and 20 inches.

The power cord 18 (shown in FIGS. 1-4) extends from the case 12 for connecting the electrical components within the case 12 to a conventional 110-volt AC line. In one embodiment, the heating and cooling apparatus 10 has a power cord strain relief or the like installed in the hole through which the power cord 18 passes.

The top portion 14 is located in an upper portion of the heating and cooling apparatus 10. The top portion 14 may be made of a metal (treated or untreated) or molded plastic. When the top 14 is made of a metal, the metal can be, for example, steel or aluminum. When a treated metal is used, the metal can be electrogalvanized or galvannealed. The metal material used for the top portion 14 can have a variety of finishes, including a black high gloss finish. The thickness of the top 14 is between 0.010 and 0.240 inches, more preferably between 0.014 and 0.100 inches, and most preferably between 0.018 and 0.034 inches.

Figure 3:
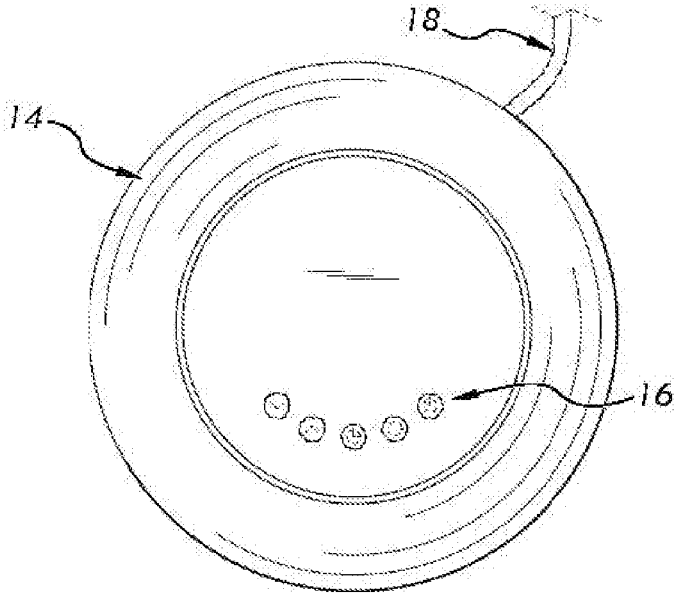
FIG. 3 is a plan view of the top of the heating and cooling apparatus of FIG. 1.
Figure 21:
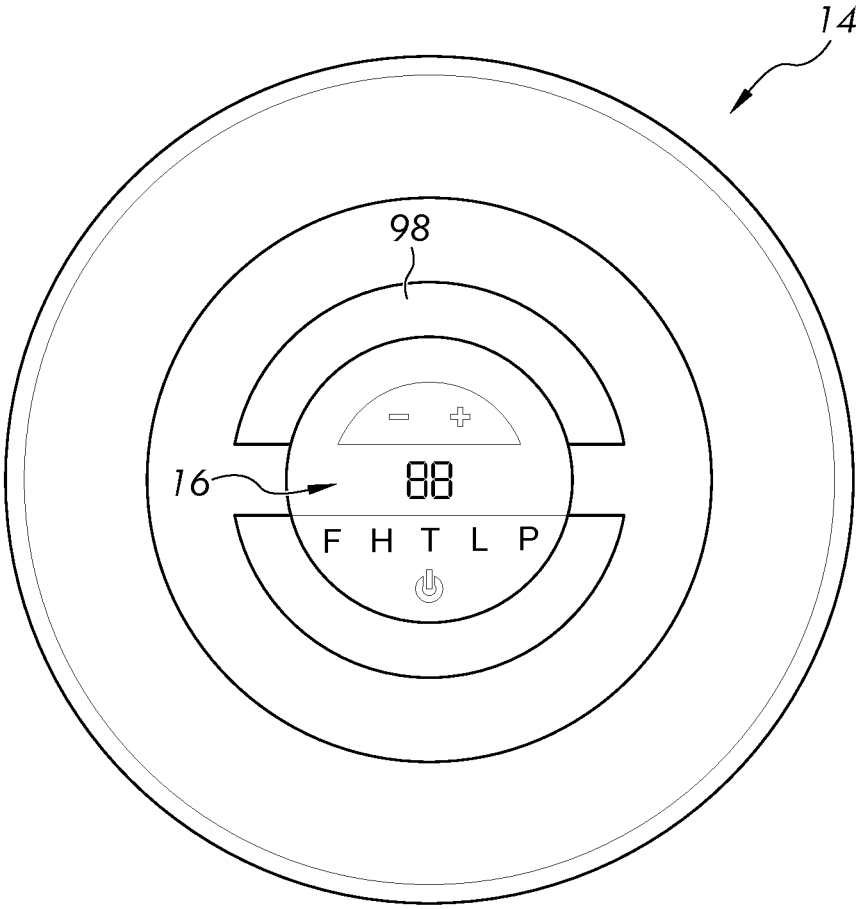
FIG. 21 is a top plan view of the heating and cooling apparatus of FIG. 11.

FIG. 3 is a plan view of the top of the heating and cooling apparatus 10. In one embodiment, the top portion 14 includes a user interface 16 with electronic controls. These controls may be touch sensitive and used to turn the device on/off, increase or decrease the temperature of air emitted from the device, adjust the mode of operation of the apparatus (i.e. heating or cooling mode), and control the audio/light components. The variable thermostatic controls can include analog and/or digital structure for adjusting an operational characteristic of the heating and cooling apparatus, such as a desired temperature or operational range (i.e., relatively hotter or cooler) and/or fan speed (i.e., relatively faster or slower), and may include various knobs, buttons, touchscreen, or other selector structure. In another embodiment, the user interface 16 includes various circuitry and/or sensors (i.e. temperature sensors, humidity sensor(s), etc., and/or timer(s)). In another embodiment, the user interface 16 includes indicia or other indicator structure to provide a visual and/or audible display of the desired settings/selections. Input/output structure, which may be located at a convenient location (e.g., on the top or sides of the heating and cooling apparatus 10) may be electrically coupled but physically located apart from user interface 16. In another embodiment, the user interface 16 provides a visual and/or audible display of service information, such as warnings, filter change notifications, and air conditioning device replacement notifications. The user interface 16 communicates with the operative components of the heating and cooling apparatus 10, such as the thermal energy source(s) and/or fan(s), to control operation thereof. In another embodiment, an automatic-mode or manual-mode switch (not shown) is provided on the exterior of the case 12. In another embodiment, a switch (not shown) is provided to operate the fan without the heating element, so as to provide air circulation. In one embodiment, the apparatus 10 includes a remote for adjusting operational controls of the heating and cooling apparatus. For example, a removable remote 98 (shown in FIG. 21) may be stored in the case 12 of the heating and cooling apparatus 10. In particular, the removable remote 98 is configured to nest on the top surface of the heating and cooling apparatus 10 when not in use. The heating and cooling apparatus 10 may also be manually controlled by the user.

Figure 22:
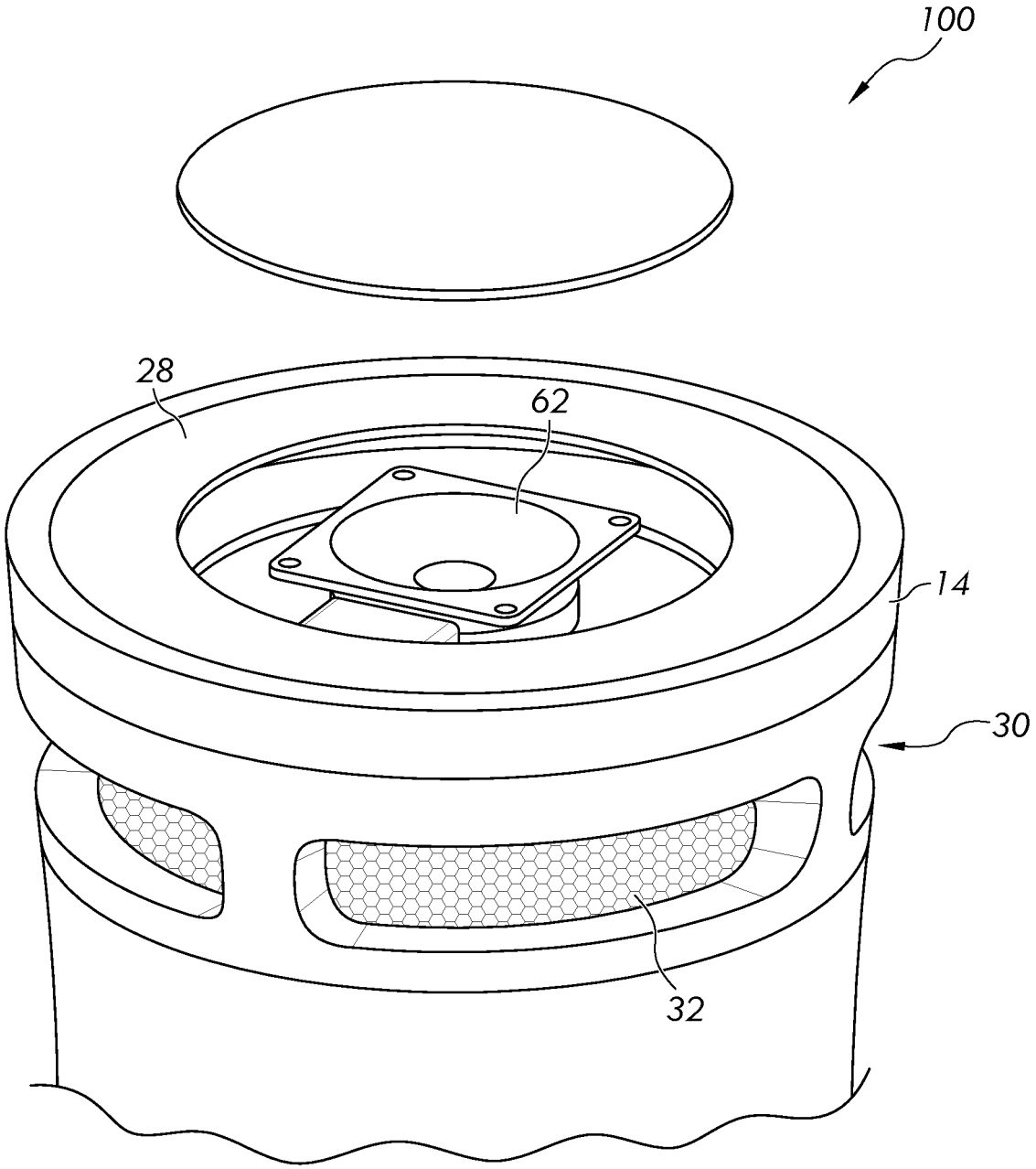
FIG. 22 is a close-up perspective view of a top portion of a heating and cooling apparatus according to a fifth embodiment.

In one embodiment, the top portion 14 includes a speaker system 100 (shown in FIG. 22) located in the top portion of the heating and cooling apparatus 10. The speaker system 100 comprises a speaker 62, a speaker grill (not shown), and a glass sheet 28. In the example illustrated in FIG. 22, a portion of the glass sheet 28 is cut away and moved vertically up to show the speaker 62 below. In another embodiment, a radio, a CD-player, and/or any other suitable device for transmitting audio is included in the heating and cooling apparatus 10.

Figure 4:
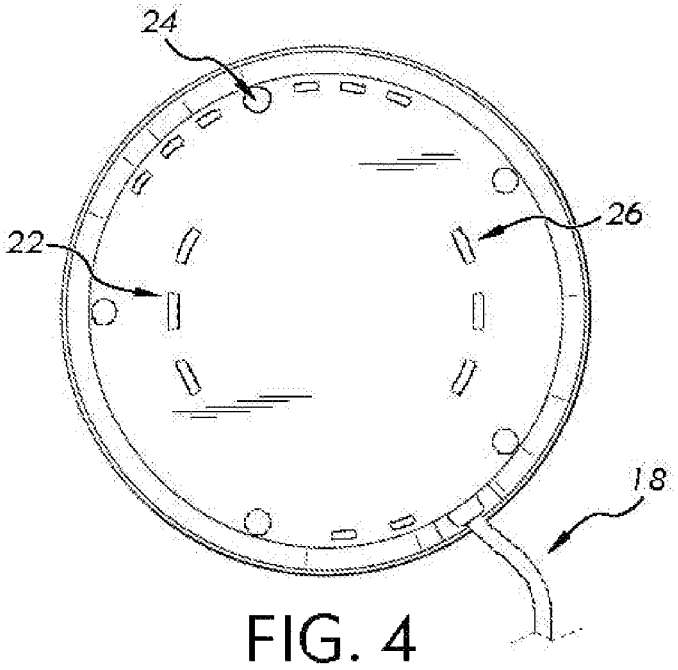
FIG. 4 is a plan view of the bottom of the heating and cooling apparatus of FIG. 1.

FIG. 4 is a plan view of the bottom of the heating and cooling apparatus. The bottom includes a base 22 having levelers 26 that can be vertically adjusted to level the apparatus 10 on an uneven surface and pads 24 to protect the surface on which the apparatus 10 is placed, for example, from being scratched. Base 22 may be made out of a polycarbonate material, for example, LEXAN® produced by SABIC. The polycarbonate material can have a variety of finishes, including a black high gloss finish. The thickness of the material used for the base 22 is preferably between 0.01 and 2 inches, more preferably between 0.1 and 0.9 inches, and most preferably between 0.3 and 0.5 inches.

Figure 5:
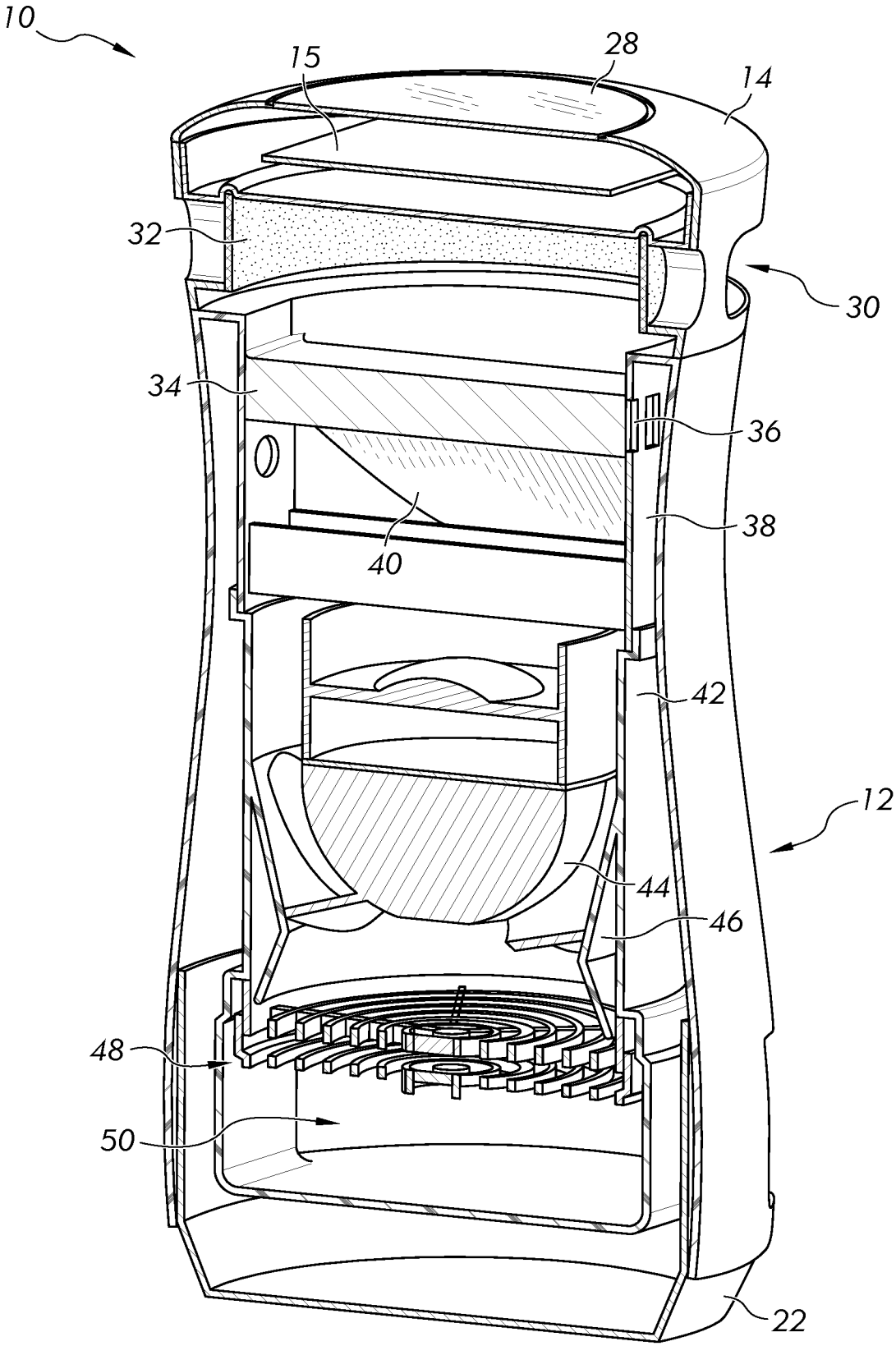
FIG. 5 is a cross-section perspective view of the embodiment of FIG. 1.

FIG. 5 is a cross-section perspective view of the embodiment of FIG. 1. In the heating and cooling apparatus 10 illustrated in FIG. 5, an air intake 50 and an air outlet 30 are provided in lower and upper portions, respectively, of the case 12. In one embodiment, the air intake 50 and the air outlet 30 are covered with protective grilles or screens, such as the screen 32. In another embodiment, a filter is positioned in at least a partially covering relationship over the air intake 50 and/or the air outlet 30. In this embodiment, various filters can be used, such as paper, foam, cotton, high efficiency particulate air (HEPA), electrostatic, activated-carbon, etc. The filter can be a single-use disposable item, or can also be cleanable and non-disposable.

In FIG. 5, the case 12 encloses a fan housing 42 and a baffle assembly. The fan housing 42 includes fan blades and exhaust blades. The baffle assembly includes a baffle 40 for directing air flow towards a PTC heating element 34 to warm the air before it exits through the air outlet 30. Air is drawn into the air intake 50 in the lower portion of the case 12 via the fan 44 and through the filter housing 48. The air then passes up through the fan housing 42 and through the baffle assembly. When the heating and cooling apparatus 10 is operating in a cooling mode, the PTC heating element 34 is not energized, and thus does not warm air that passes through the apparatus 10. Instead, air passes both through and around the heat chamber 38 and then exits through the outlet 30. When the heating and cooling apparatus 10 is operating in a heating mode, the baffles 40 direct the airflow to pass through the heat chamber only, and then electricity is passed through the PTC heating element 34, causing the element 34 to heat up, which warms the air passing through the heat chamber 38. The heated air then exits through the outlet 30 located near the top of the case 12.

The PTC heating element 34 is a positive temperature coefficient heater. As shown in FIG. 5, the PTC heating element 34 is a conventionally configured, rectangular shaped device. The primary benefit of using the PTC heating element 34 is that the resistivity increases exponentially with increasing temperature, meaning that the temperature of the PTC heating element 34 will not exceed a predetermined temperature. Accordingly, the risk of overheating is reduced compared to traditional heating elements.

Accordingly, the heating and cooling apparatus 10 provides year-round climate control using PTC heating technology, and a combination of a cooling device aided by a thermo-electric cooling device. The heating and cooling apparatus 10 provides, heating, passive air conditioning, and air circulation capabilities in a single unit.

In yet another embodiment, the heating and cooling apparatus 10 includes a humidifier (not shown) that can utilize a water supply to modify the relative humidity of the air passing through the heating and cooling apparatus. For example, the humidifier can relatively increase the humidity in the air stream. Various types of humidification can be utilized, including hot and cold methods of increasing humidity in the air stream. The humidifier can utilize a re-fillable water supply or could even be connected to a constant water supply line. Additionally, the humidifier could be provided with a water drain and/or a catch basin that can have a fixed volume or discharge hose. In another embodiment, the humidifier can relatively decrease the humidity in the air stream. A conventional compressor-driven cooler dehumidification system, or other similar types, can be used.

Figure 6:
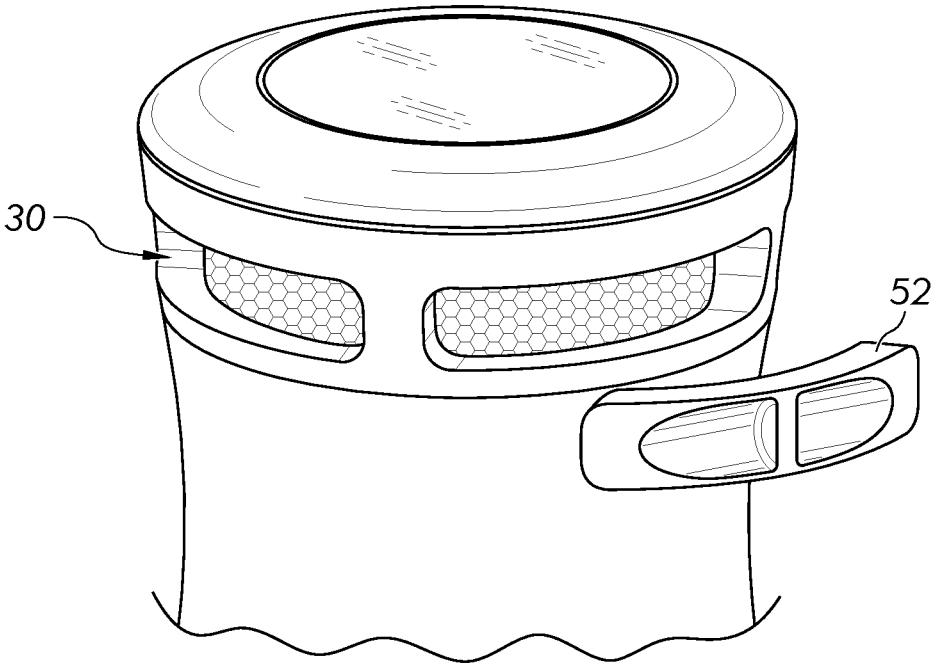
FIG. 6 is a close-up perspective view of an upper portion of the heating and cooling apparatus of FIG. 1 and a plug configured to fit within an air outlet.

FIG. 6 is a close-up perspective view of an upper portion of the apparatus 10 and a plug 52 configured to fit within the air outlet 30. The plug 52 may be inserted into the air outlet 30 when the apparatus is in operation or not in operation, as well as utilized in any mode, including heat mode, cool mode, or fan mode. In one embodiment, the apparatus 10 includes a plurality of plugs 52 that are each configured to fit within an air outlet 30. The plug or plugs 52 assist in creating a more concentrated airflow from one or more air outlets 30 and reducing sound emitted from the heating and cooling apparatus 10. The plug 52 may be made of injection molded plastic, metal, including steel, aluminum, and brushed aluminum, or any other material that may be heat resistant and/or the same or similar material to the case 12. In one embodiment, one or more plugs may include a HEPA filter.

Figure 7:
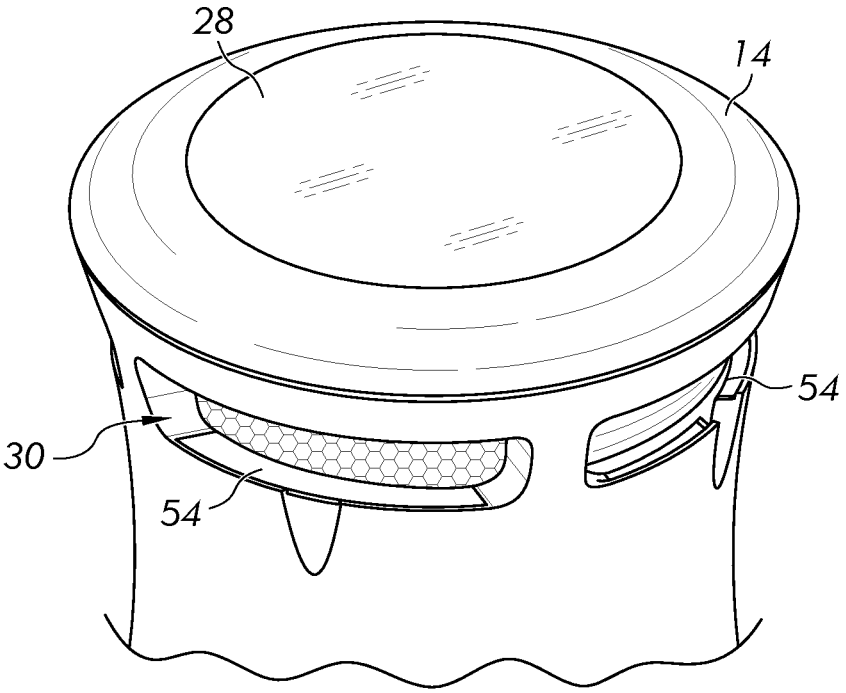
FIG. 7 is a close-up perspective view of an upper portion of a heating and cooling apparatus according to a second embodiment.

FIG. 7 is a perspective view of one embodiment of the apparatus 10 that includes a retractable cover 54 for the air outlet 30. The retractable cover 54 may be separate from or integral to the heating and cooling apparatus 10. In one embodiment, the retractable cover 54 is manually operated. For example, to manually close the air output 30 with the retractable cover 54, a groove, below the air output 30, can be used to initially slide the retractable cover 54 until it makes contact with the opposing surface of the air outlet 30. The cover 54 maintains a closed position covering the air output 30 by magnets or any other temporary fastening device. The magnets or other temporary fastening device can be located in the opposing surface of the air outlet 30, in a surface of the retractable cover 54, or in both the opposing surface of the air outlet 30 and the surface of the retractable cover 54. To open the air outlet 30, a user can push the retractable cover 54 in the opposing direction of the temporary connection and with sufficient force to overcome the temporary connection. When the air outlet 30 is open, the retractable cover 54 can be located or stored in a seated down position that is flush or slightly below the lower surface of the air outlet 30. FIG. 7 shows one retractable cover 54 in a closed position and another retractable cover 54 in the open position. The retractable cover 54 may also be automatically operated by any motor or system commercially available.

Figure 8:
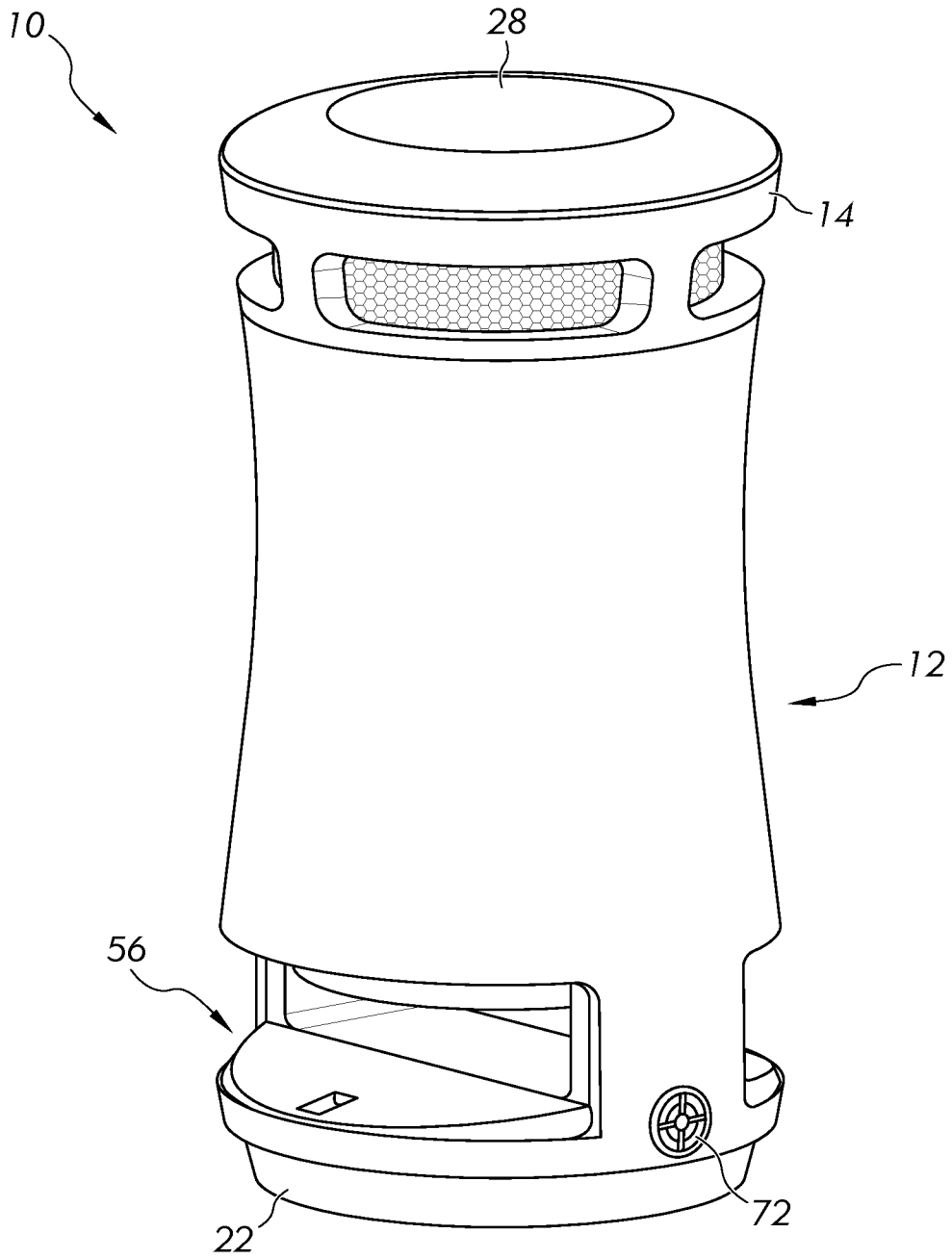
FIG. 8 is a perspective view of a heating and cooling apparatus according to a third embodiment.

FIG. 8 is a perspective view of an alternative embodiment of the heating and cooling apparatus 10 having an air purification system 56. In this embodiment, at least a portion of the air purification system 56 is housed in the base 22 of the apparatus 10 while receiving air through the base intake 72 (shown in FIG. 9).

Figure 9:
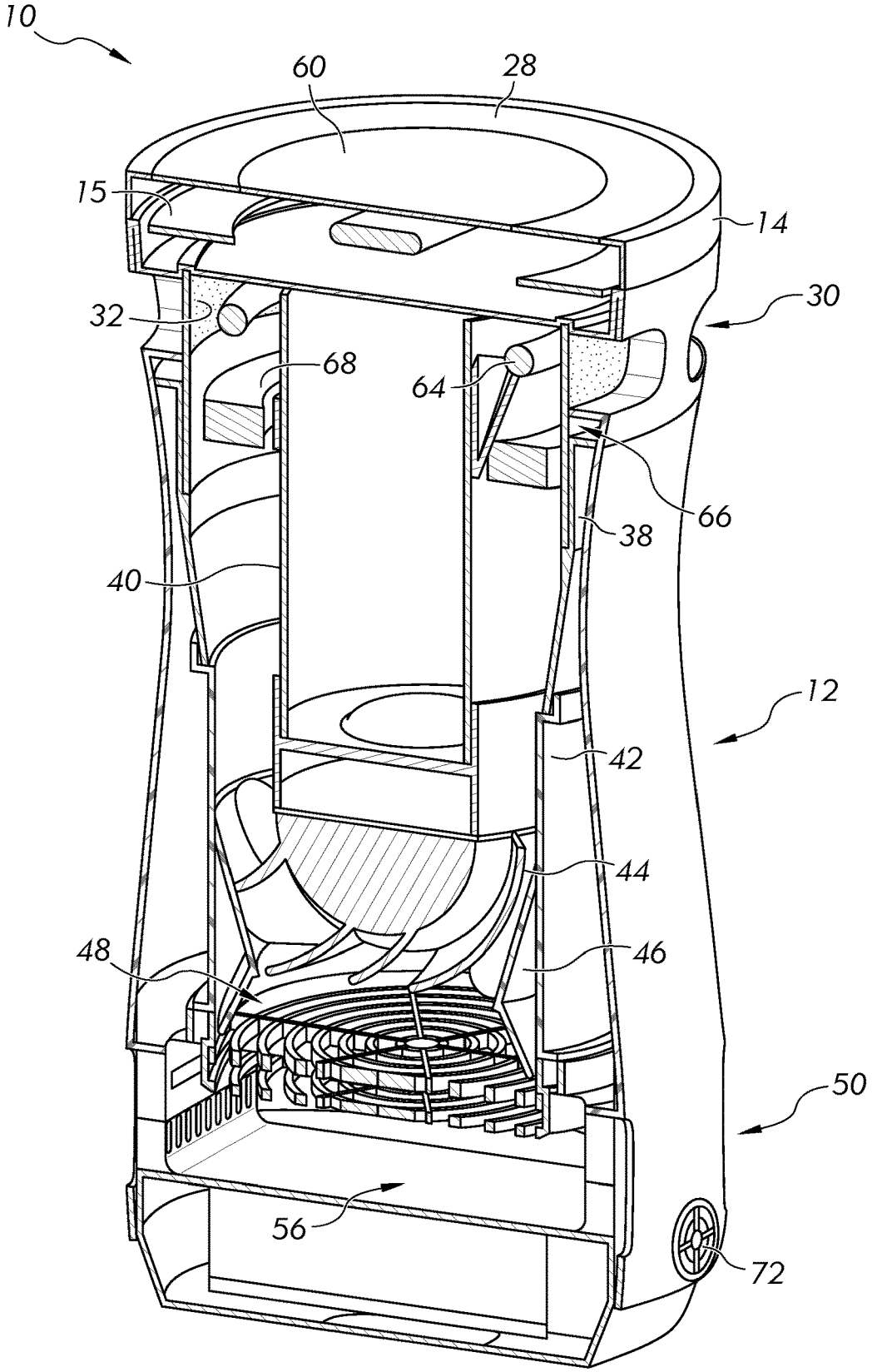
FIG. 9 is a cross-section perspective view of the embodiment of FIG. 8.

FIG. 9 is a cross-section perspective view of the embodiment of FIG. 8. In FIG. 9, the case 12 encloses a fan housing 42 and a baffle assembly. The fan housing 42 includes fan blades and exhaust blades. The baffle assembly includes a baffle 40 for directing air flow towards a hybrid heating element that includes both a torus ring-shaped PTC heating element 68 and an infrared bulb/heating element 64 described in more detail below. Air is drawn into the air intake 50 in the lower portion of the case 12 via the fan 44 and through the filter housing 48. The air then passes up through the fan housing 42 and through the baffle assembly. When the heating and cooling apparatus 10 is operating in a cooling mode, the heating element is not energized, and thus does not warm air that passes through the apparatus 10. Instead, air passes both through and around the heat chamber 38 and then exits through the outlet 30. When the heating and cooling apparatus 10 is operating in a heating mode, the baffle 40 directs the airflow to pass through the heat chamber only, and the heating element heats up (as described in more detail below) to warm the air passing through the heat chamber 38. The heated air then exits through the outlet 30 located near the top of the case 12.

Figure 10:
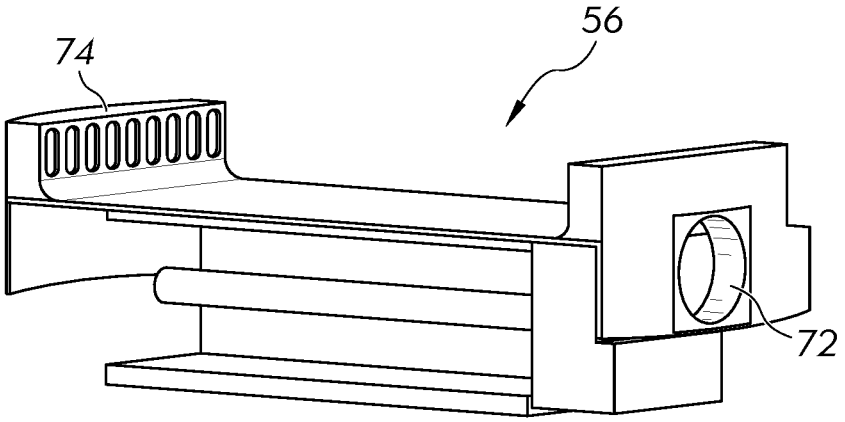
FIG. 10 is a cross-section perspective view of the air purification system used in the heating and cooling apparatus of FIG. 8.

FIG. 10 is a cross-section perspective view of one embodiment of an air purification system 56 of the heating and cooling apparatus. In this embodiment, a fan within the air intake 72 provides the airflow necessary to pass through or across the air purification system 56. This air will exit through vents 74 at the base 22 of the heating and cooling apparatus 10, be drawn into the intake 50, and exit through the air outlet 30. In one embodiment, the air purification system 56 removes smoke, pollen, dust, pet dander, carbon monoxide, dust mites, fumes, vapors, odors, allergens, and/or any other air pollutant or irritant found in the air. By removing impurities within the air, the air purification system 56 also freshens the air.

In one embodiment, the heating and cooling apparatus 10 purifies air via conventional methods. For example, the apparatus 10 may include an ozone air purifier (not shown), a plasma air ionization device (not shown), and/or a photocatalytic air purifier 56. Ozone air purification may be accomplished by the use of ultraviolet (UV) light and/or an electrical discharge to intentionally produce ozone. Plasma air ionization can be accomplished by needle-point brush-type ionizers that produce an equal amount of positive and negative ions neutralizing harmful pollutants and odors. Photocatalytic air oxidation (PCO) may be accomplished by the use of a UV lamp along with a catalytic substance that reacts with light, such as titanium dioxide.

One embodiment of the air purification system includes a secondary fan(s); a titanium dioxide PCO device; and a HEPA filter. Embodiments of the heating and cooling apparatus 10 as disclosed herein may also have pre-filters to ensure high quality air purification and equipment reliability.

In another embodiment, the heating and cooling apparatus 10 includes a filter replacement indicator located in the user interface 16.

In one embodiment, the heating and cooling apparatus 10 includes additional sterilizing, anti-bacterial, and/or deodorizing conditioning of the air flow. In one example, various portions of the heating and cooling apparatus 10 are coated with sterilizing, antibacterial, and/or deodorizing coating(s) to provide such additional conditioning of the air flow. Sterilizing, antibacterial, and/or deodorizing coating(s) can be applied about the air intake 50 or the air outlet 30, such as to portions of the adjacent exterior case 12. In another embodiment, the sterilizing, antibacterial, and/or deodorizing coatings are applied to one or more faces of the screen 32. In another embodiment, the sterilizing, antibacterial, and/or deodorizing coatings are applied to interior surfaces of the apparatus 10 that contact the air flow, such as within the fan assembly and/or the heat chamber 38.

Various sterilizing, antibacterial, and/or deodorizing coatings can be utilized. For example, the coatings can contain silver, titanium oxide and/or copper, though other materials can also be used. In one example, nano-silver can be used that is a resin composition containing silver nanometer-sized particles. The sterilizing, antibacterial, and/or deodorizing coatings can be applied via various methods, including chemical deposition or wet coating.

Coatings may wear off over time and reduce the sterilizing, antibacterial, and/or deodorizing effectiveness. For this reason, it is beneficial to provide the coatings in such a manner that they are long-lasting and resistant to being removed via physical contact and/or periodic cleaning, as well as being efficient and cost-effective for manufacturing (e.g., using relatively less nano-silver material). In one embodiment, nano-silver particles are incorporated into a sprayable media, such as a UV-curable ink. The ink may be relatively clear so as not to alter the outward appearance of the coated items. Alternatively, the ink may have various colors, surface features, etc. This modified UV-curable ink is then sprayed or otherwise deposited onto the desired portions of the heating and cooling apparatus 10. In particular, the ink is sprayed onto and throughout the screen 32. Next, the coated item is exposed to UV radiation to thereby be permanently cured on the desired portion of the apparatus 10. Using this method, nano-silver particles will be dispersed throughout the cured ink, which permits the silver particles to perform the sterilizing, antibacterial, and/or deodorizing function, while also protecting the silver particles from being removed over time.

It is understood that any portion of the heating and cooling apparatus 10 can be provided with the sterilizing, antibacterial, and/or deodorizing coating. While the coating can be used to condition the air flow, similar coatings can also be applied to the various exterior surfaces of the heating and cooling apparatus 10 that an end user may touch. For example, the exterior case 12, the user interface 16, and the surfaces adjacent the air inlet and/or the air outlet.

Figure 11:
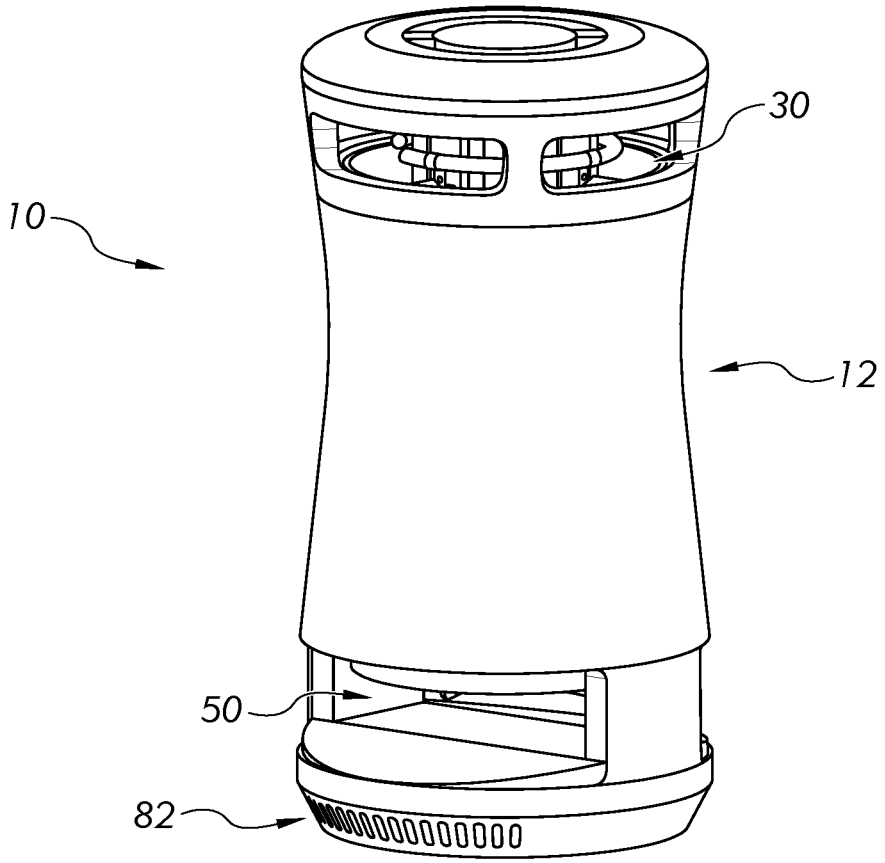
FIG. 11 is a perspective view of a heating and cooling apparatus according to a fourth embodiment wherein a screen has been removed from the air outlets.
Figure 12:
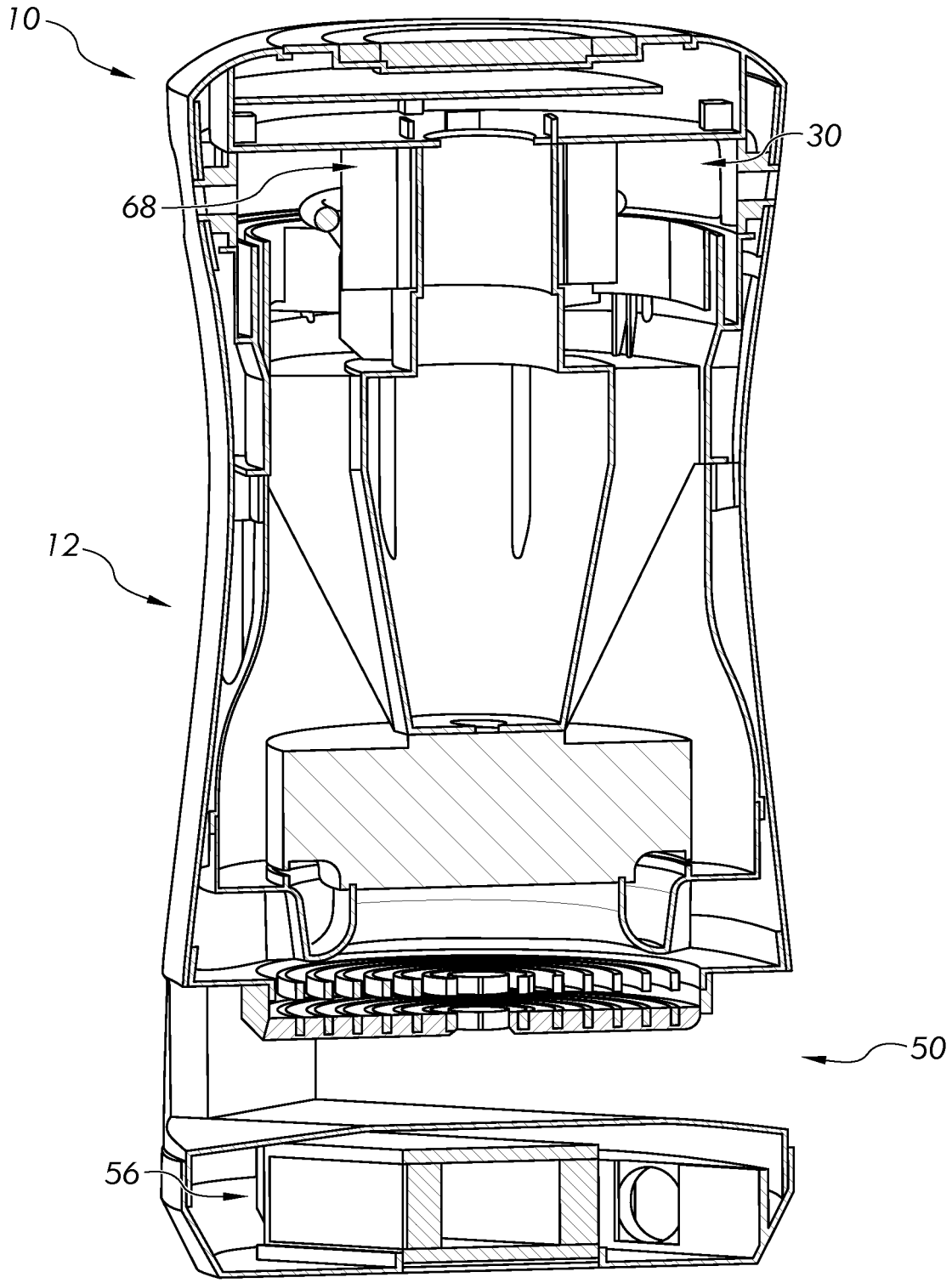
FIG. 12 is a cross-section perspective view of the embodiment of FIG. 11.

FIG. 11 is a perspective view of an alternative embodiment of a heating and cooling apparatus 10 having an air purification system. FIG. 12 is a cross-section view of the embodiment of FIG. 11. In the heating and cooling apparatus 10 embodiment illustrated in FIGS. 11 and 12, an air intake 50 and an air outlet 30 are provided in lower and upper portions, respectively, of the case 12. The air intake 50 and the air outlet 30 can be covered with protective grilles or screens. In another embodiment, a filter is positioned in at least a partially covering relationship over the air intake 50 and/or the air outlet 30. Various filters can be used, such as paper, foam, cotton, HEPA, electrostatic, activated-carbon, etc. The filter can be a single-use disposable item, or can also be cleanable and non-disposable.

Figure 13:
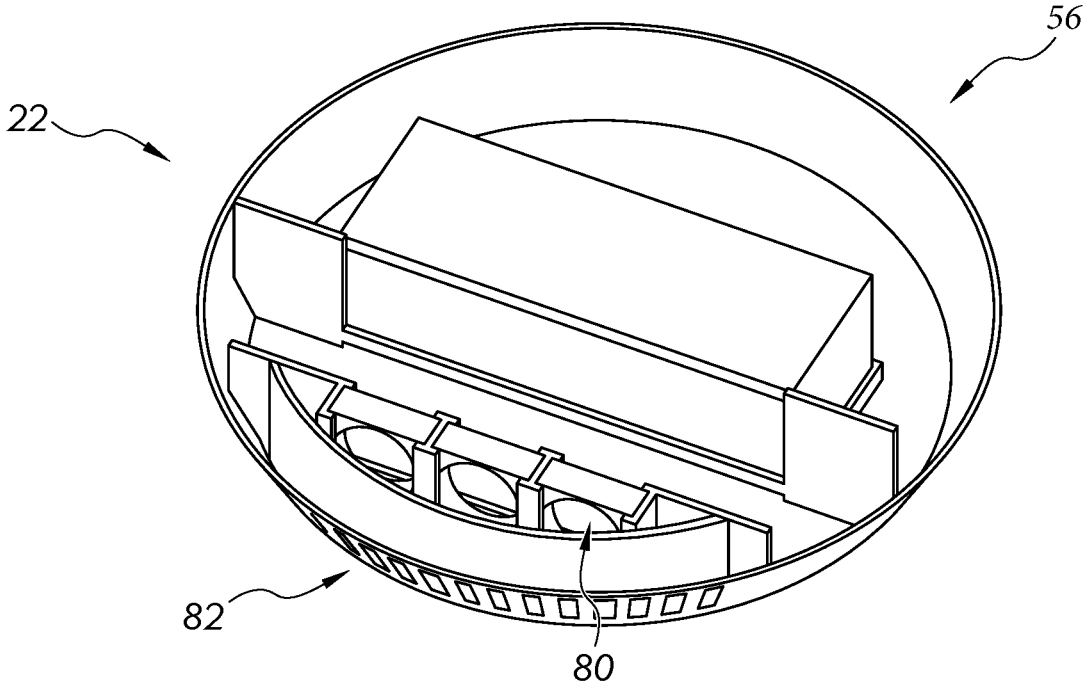
FIG. 13 is a perspective view of the air purification system of the heating and cooling apparatus of FIG. 11.
Figure 14:
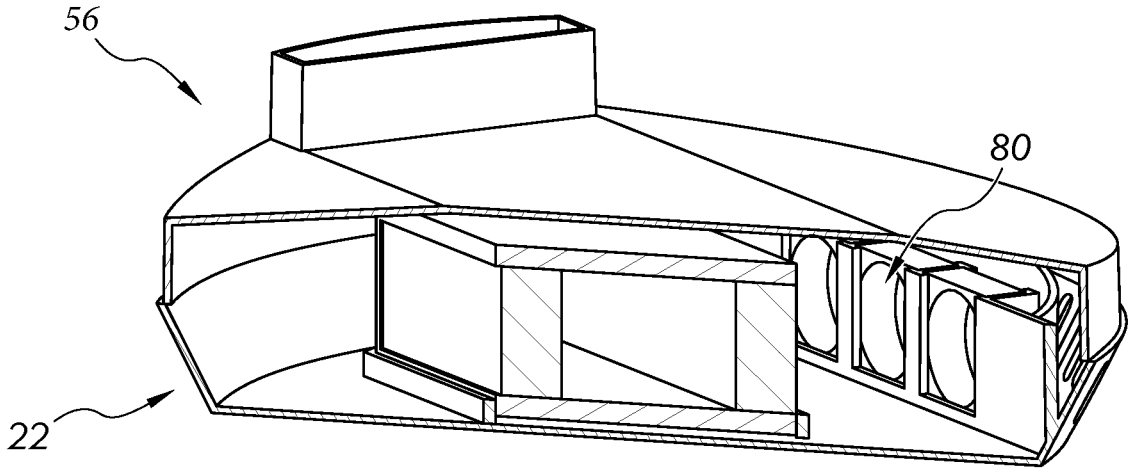
FIG. 14 is a cross-section perspective view of the air purification system of FIG. 13.
Figure 15:
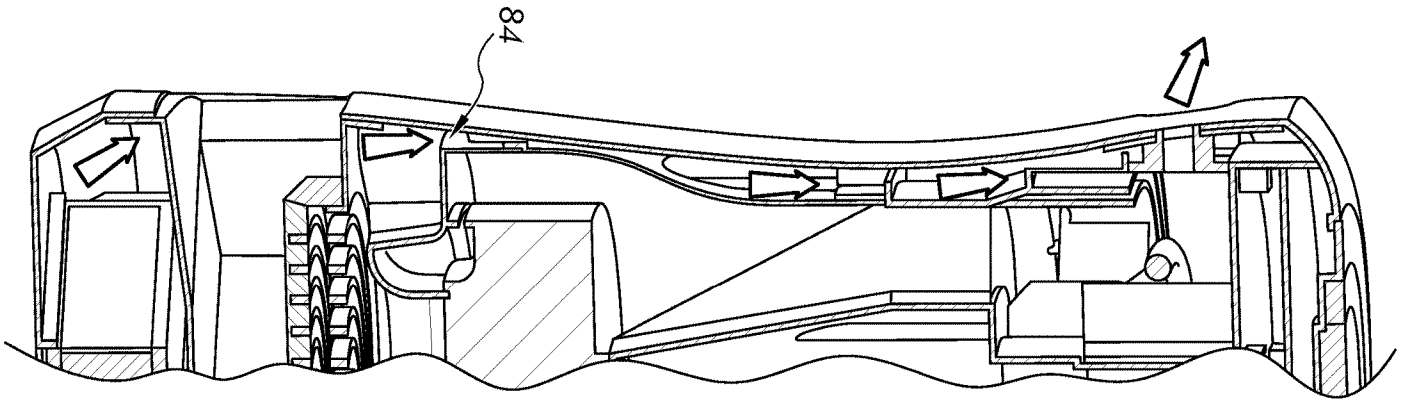
FIG. 15 is a cross-section perspective view of the heating and cooling apparatus of FIG. 11 illustrating the path of air flow through the apparatus.
Figure 16:
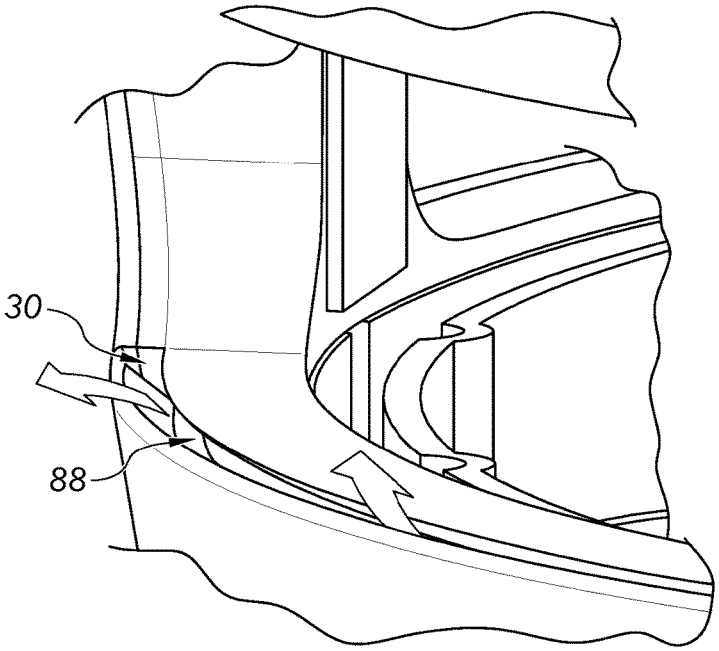
FIG. 16 is a close-up perspective view of the heating and cooling apparatus of FIG. 11 illustrating the path of air flow adjacent the air outlet.

Moreover, at least a portion of the air purification system 56 of FIGS. 11 and 12 is housed in the base 22 of the apparatus 10 while receiving air through the base intake 82. FIGS. 13 and 14 are cross-section perspective views of the air purification system 56 illustrated in FIG. 11. In this embodiment, three fans 80 draw air through or across the air purification system 56. Purified air then passes upward through a separate airflow chamber 84 (shown in FIG. 16), which begins in the base 22, rises upwards through the struts connecting the base to the main case 12, and further upward between the outer wall of the main case 12, and an inner wall of the apparatus (FIG. 15). The purified air will then exit the apparatus 10 at exit ports 88 located adjacent the air outlet 30. In one embodiment, the apparatus 10 includes one or more exit ports 88, including 1, 2, 3, 4, 5, 6, or more exit ports 88. In other embodiments, the air purification system 56 removes smoke, pollen, dust, pet dander, carbon monoxide, dust mites, fumes, vapors, odors, allergens, and/or any other air pollutant or irritant found in the air. By removing impurities within the air, the air purification system 56 freshens the air.

The air purification system 56 can be operated independently of either the heating or the cooling modes of the apparatus 10. This allows the air purification system 56 to be operated as an air purifier and air freshener.

Figure 17:
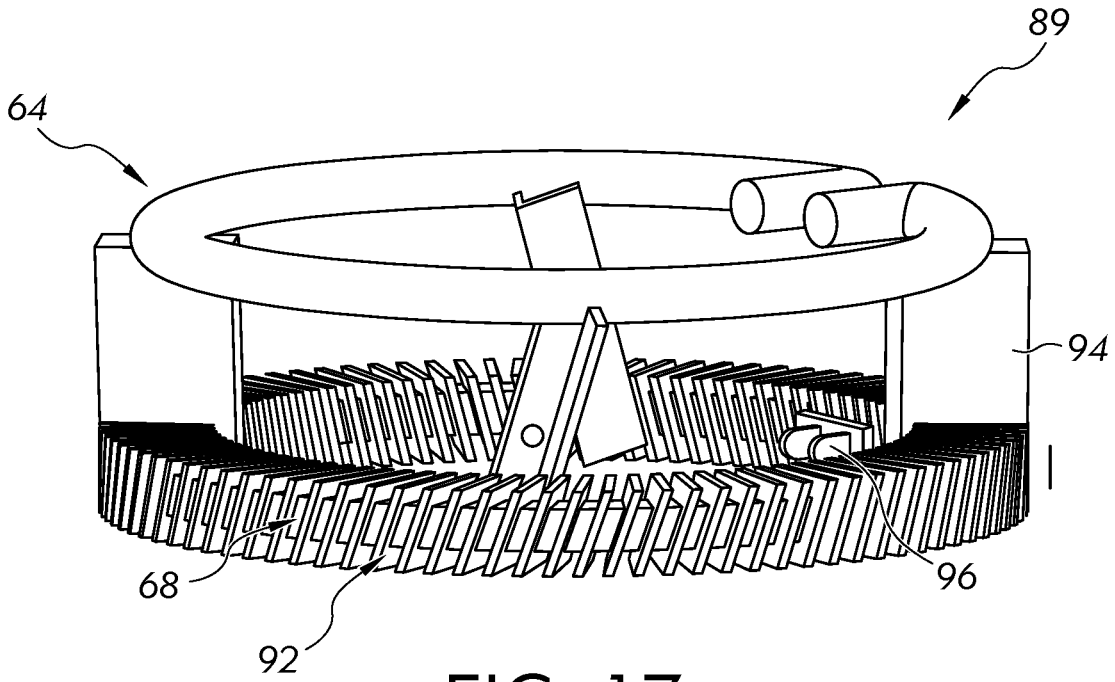
FIG. 17 is a perspective view of a torus ring-shaped heating element and heat-exchanger fins for use in embodiments of the heating and cooling apparatus.
Figure 18:
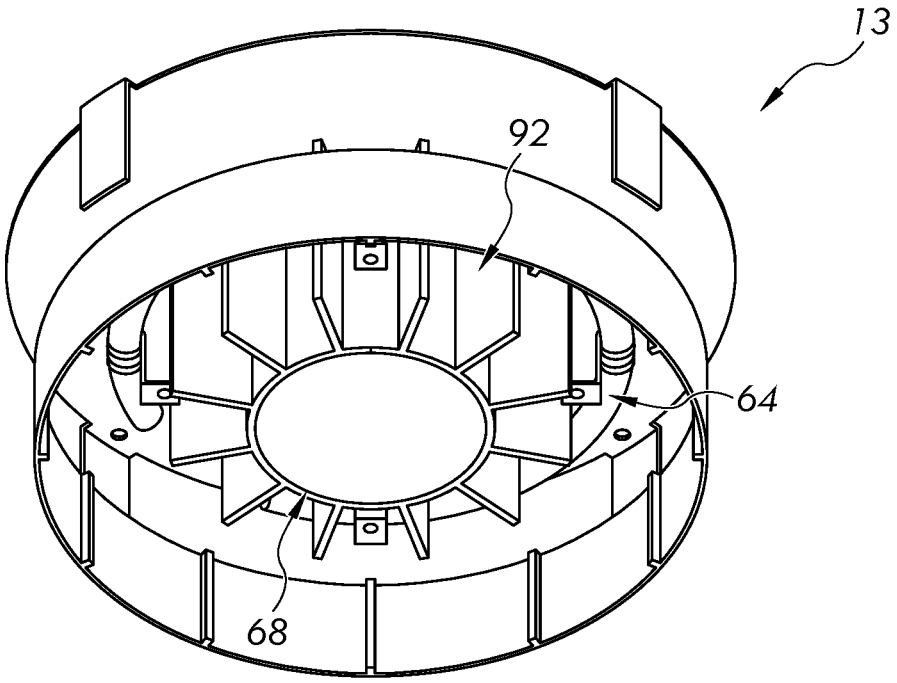
FIG. 18 is a perspective view of a heat exchanger of the heating and cooling apparatus of FIG. 11.
Figure 20:
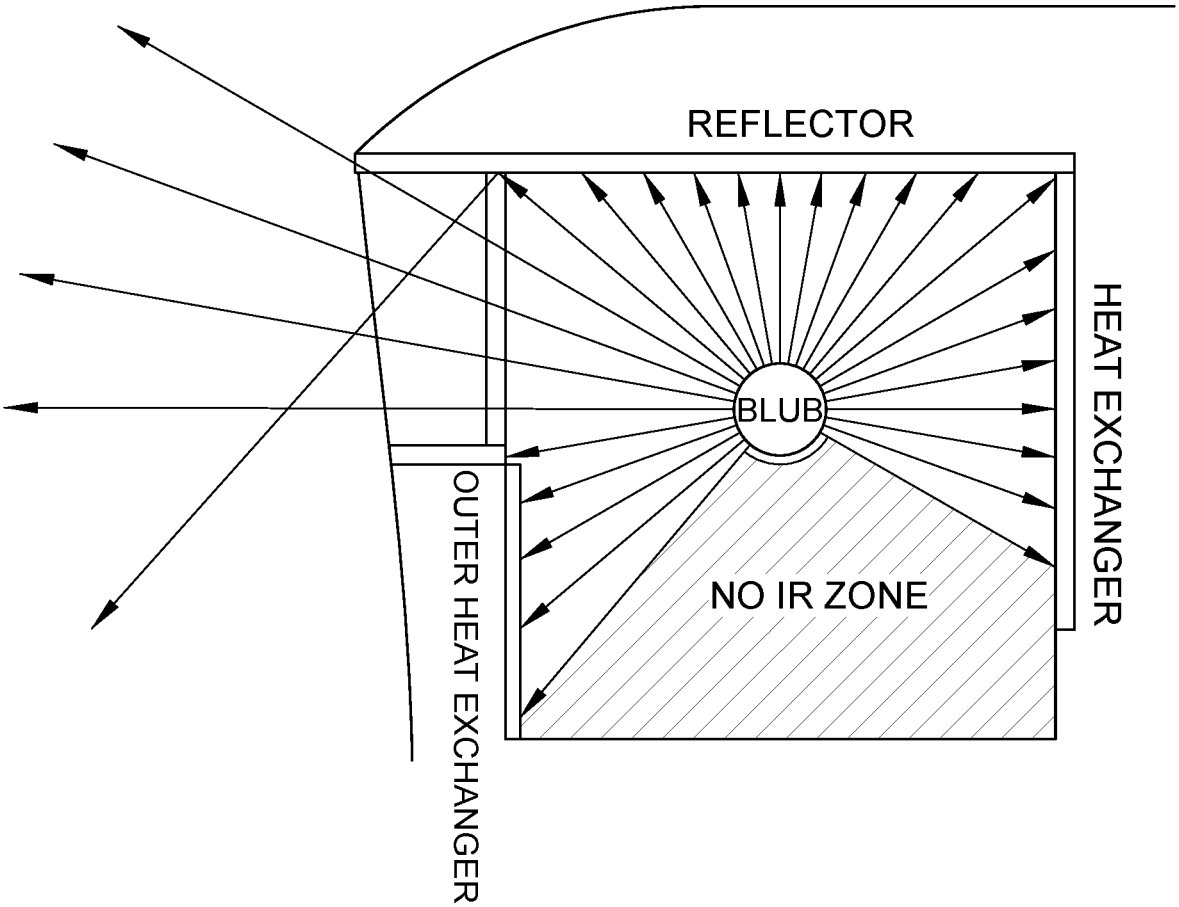
FIG. 20 is a graphical representation of the directional path of radiant energy created by the infrared heating element of the heating and cooling apparatus of FIG. 11.

FIGS. 9 and 12 also depict a PTC heating element that features a torus ring-shaped design. FIG. 17 is a perspective view of a hybrid heating element 89 for use within embodiments of the heating and cooling apparatus 10. The hybrid heating element 89 includes both a torus ring-shaped PTC heating element 68 and an infrared bulb/heating element 64. The hybrid heating element 89 enables the heating and cooling apparatus 10 to provide direct radiant heat from the infrared heating element 64. This embodiment may be positioned within the heating and cooling apparatus 10 to enable the radiant waves to both exit directly through the air outlets 30, as well as transfer radiant energy directly to heat exchanger fins 92, located in the immediate proximity of the infrared heating element itself, as shown in FIG. 18. The infrared energy absorbed by the heat exchanger fins 92 will be transferred to the passing airflow as conductive heat as the air passes over the heat exchanger fins 92 and exits the outlets 30. An example illustrating the directional path of the radiant energy created by the infrared heating element 64 is depicted in FIG. 20. The infrared heating element 64 is positioned on the ends of the mounting brackets 94 that extend past the height of the heat-exchanger fins 92. To prevent radiant energy from the infrared heating element 64 from affecting the operation of the PTC heating element 68, an infrared bulb with directional masking and/or the inclusion of a mechanical heat shield (not shown) may be used. In another embodiment, the PTC heating element 68 and the infrared heating element 64 are operated independently and thus require no masking or mechanical heat shield. Various heat shielding methods can ensure proper operation of the PTC heating element 68 by restricting the radiant heat from coming in contact with the PTC heating element 68. Examples of heat shielding methods include directional infrared bulb masking, proximity/size differences between the PTC heating element 68 and the infrared heating element 64, mechanical shielding, etc.

The mounting brackets 94 are preferably arranged relative to the PTC heating element 68 at an angle of 85 to 45 degrees, preferably from 80 to 50 degrees, more preferably from 75 to 55 degrees, and still more preferably 70 to 60 degrees. Although the embodiments shown in FIGS. 17, and 20A include four, equally-spaced mounting brackets 94, the number of mounting brackets 94 may vary based on the number of structural supports present in the appliance. For example, the hybrid heating element 89 may include 1, 2, 3, 4, 5, or 6 mounting brackets 94. One end of each mounting bracket 94 may be flush with adjacent heat-exchanger fins 92 while the opposing end of the mounting bracket 94 may extend past the height of adjacent heat-exchanger fins 92. The length of each mounting bracket 94 may vary based on the structural supports present in the appliance. Further, while the mounting brackets 94 in FIG. 17 have an L-shape, the brackets 94 can have any suitable configuration, size, and/or shape, such as a T-shape bracket (not shown). The mounting brackets 94 are formed from a plate or sheet of metal, such as aluminum, steel, or stainless steel.

As shown in FIG. 17, electrodes 96 are electrically coupled to the PTC heating element 68 so that electrical current may be conducted between them. When an electrical bias is applied to the electrodes 96, the resulting current through the PTC heating element 68 causes the heat-exchanger fins 92 to heat up. In turn, heat is transferred to air passing over and through the hybrid heating element 89.

The heat-exchanger fins 92 are attached to or formed integrally with the PTC heating element 68. The element 68 can have a cross-section that is a circular disk, or a square, a rectangle, a triangle, or any other shape. The fins 92 can have a shape that is circular, a square, a rectangle, a triangle, or any other shape. The fins 92 can be arranged at an angle relative to the element 68 in order to maximize contact with a fluid that passes over the hybrid heating element 89. The hybrid heating element 89 is arranged such that an air flow passes over and through the hybrid heating element 89 before the air flow exits the apparatus 10. When the hybrid heating element 89 is used in an apparatus 10 with a fan that provides air flow, the angle that the fins 92 are arranged relative to the element 68 can be optimized to complement the fan blade pitch, resulting in maximized air flow over and through the hybrid heating element 89. The fins 92 are preferably arranged relative to the element 68 at an angle of 180, 175, 170, 165, 160, 155, 150, 145, 140, 135, 130, 125, 120, 115, 110, 105, 100, 95, 90, 85, 80, 75, 70, 65, 60, 55, 50, 45, 40, 35, 30, 25, 20, 15, 10, 5, or 0 degrees. For example, as shown in FIG. 17 the heat-exchanger fins 92 are arranged at an angle of 75 degrees relative to the element 68. The angle of the heat-exchanger fins 92 to the element 68 is adjusted to be complementary to the airflow produced by a fan within the same appliance. The angle is based on the appliance and the fan used therein and performance specifications for heat transfer and air velocity.

Further, when the hybrid heating element 89 is used as a heat source in an appliance, such as the apparatus 10, the PTC heating element 68 is positioned in the outermost area of the air flow generated by the fan. This results in an efficient transfer of the infrared energy directly to the surrounding surfaces and/or the user. In one embodiment, the air flows in a helical direction to a plane of the element 68. In another embodiment, the air flows in a perpendicular direction to a plane of the element 68.

In one embodiment, the PTC heating element 68 is made of a metal clad ceramic material, such as barium titanate ($BaTiO_3$) or a lead titanate composite wherein the BaO component of $BaTiO_3$ is partly replaced by the component PbO. In other embodiments, the PTC heating element 68 is made of any PTC ceramic material known in the art, such as molybdenum disilicide ($MoSi_2$). In additional embodiments, the PTC heating element 68 is made of any polymer PTC material known in the art. The Curie point of the ceramic material is in the range of from 140° C. to 210° C., from 150° C. to 185° C., and from 170° C. to 180° C. In one embodiment, the heat exchanger fins 92 are made of a different material than the PTC heating element 68, including a conductive metal material, such as copper or aluminum. In alternative embodiments, the heat exchanger fins 92 are made of the same material as the PTC heating element 68.

In one embodiment, the infrared heating element 64 is a single torus-shaped bulb, as shown in FIG. 17. In other embodiments, the infrared heating element 64 includes a plurality of individual bulbs that collectively form a torus-ring shape. For example, the infrared heating element 64 may include six separate and individual infrared heat bulbs, each comprising 60 degrees of the torus-ring shape. The individual segments may operate at the same time, or one or more of the bulbs may operate to produce the desired amount of heat. A commercially-available infrared heat bulb can be used with the hybrid heating element 89. In other embodiments, the infrared heating element 64 includes 2, 3, 4, 5, 7, or 8 individual bulbs that collectively form a torus-ring shape. Electrodes are electrically coupled to the infrared heating element 64 so that electrical current is conducted between them. When an electrical bias is applied to the electrodes, the resulting current through the infrared heating element 64 causes the element to heat up.

In one embodiment, the infrared heating element 64 is made with quartz tubes. In other embodiments, the infrared heating element 64 is made of quartz lamps, ceramic emitters, or metal tubulars.

Figure 19:
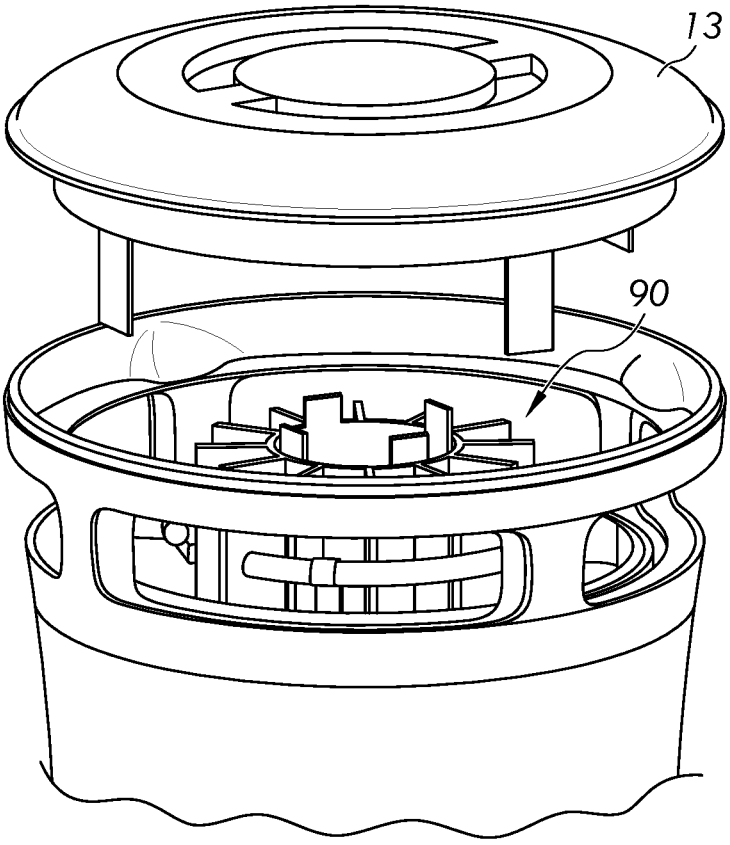
FIG. 19 is a perspective view showing a removable top of the heating and cooling apparatus of FIG. 11.

The heating and cooling apparatus 10 depicted in FIG. 11 can also include a removable top (FIGS. 18-19), thus allowing for the easy replacement of the heat source in the event of failure.

The invention has been described with reference to the example embodiments described above. Modifications and alterations will occur to others upon a reading and understanding of this specification. Examples of embodiments incorporating one or more aspects of the invention are intended to include all such modifications and alterations insofar as they come within the scope of the appended claims.

What is claimed is:

1. A heating and cooling apparatus, comprising:

a case comprising a first air intake and an air outlet;

an air chamber disposed within the case in fluid communication with the first air intake and the air outlet and defining a primary air pathway;

a fan configured to draw air through the air chamber;

a heating element within the air chamber and interposed between the first air intake and air outlet, and a baffle configured to direct air flow towards the heating element, wherein the heating element comprises a torus ring-shaped positive temperature control element and an infrared element.

2. The heating and cooling apparatus of claim 1, further comprising a removable top.

3. The heating and cooling apparatus of claim 1, further comprising a plug that is configured to fit within the air outlet.

4. The heating and cooling apparatus of claim 1, further comprising a speaker system.

5. The heating and cooling apparatus of claim 1, further comprising a user interface.

6. The heating and cooling apparatus of claim 1, further comprising a removable remote control.

7. A heating and cooling apparatus, comprising:

a case comprising a first air intake and an air outlet;

an air chamber disposed within the case in fluid communication with the first air intake and air outlet and defining a primary air pathway;

a fan configured to draw air through the air chamber;

a heating element within the air chamber and interposed between the first air intake and air outlet, and a baffle configured to direct air flow towards the heating element; and an air purification system, wherein the heating element comprises a torus ring-shaped positive temperature control element and an infrared element.

8. The heating and cooling apparatus of claim 7, the air purification system comprising a secondary fan source, a second air intake, and an air exhaust chamber, wherein the purified air stream is isolated from the primary air pathway.

9. The heating and cooling apparatus of claim 8, the air purification system further comprising a high efficiency particulate air filter.

10. The heating and cooling apparatus of claim 7, wherein the air purification system is an ozone air purifier, a plasma air ionization device, or a photocatalytic air purifier.

11. The heating and cooling apparatus of claim 10, wherein the air purification system is a photocatalytic air purifier and further comprises a titanium dioxide photocatalytic air oxidation device.

12. The heating and cooling apparatus of claim 7, further comprising a removable top.

13. The heating and cooling apparatus of claim 7, further comprising a plug that is configured to fit within the air outlet.

14. The heating and cooling apparatus of claim 7, further comprising a speaker system.

15. The heating and cooling apparatus of claim 7, further comprising a user interface.

16. The heating and cooling apparatus of claim 7, further comprising a removable remote control.

17. A heating and cooling apparatus, comprising:

a case comprising a first air intake and an air outlet;

an air chamber disposed within the case in fluid communication with the first air intake and the air outlet and defining a primary air pathway;

a fan configured to draw air through the air chamber;

a heating element within the air chamber and interposed between the first air intake and air outlet, and a baffle configured to direct air flow towards the heating element, wherein the heating element comprises a torus ring-shaped positive temperature control element, an infrared element, and heat exchanger fins.

18. The heating and cooling apparatus of claim 17, wherein the heat exchanger fins are attached to the torus ring-shaped positive temperature control element.

19. The heating and cooling apparatus of claim 18, wherein the heat exchanger fins are arranged relative to the torus ring-shaped positive temperature control element at an angle of 50 degrees to 100 degrees.

* * * * *